US005833511A

United States Patent [19]

Outman

[11] Patent Number: 5,833,511

[45] **Date of Patent: *Nov. 10, 1998**

[54] TRANSFORMABLE GEOMETRIC CONSTRUCTION SET AND THREE-DIMENSIONAL STRUCTURES CONFIGURABLE THEREFROM

[76] Inventor: Karl S. Outman, 6F Adrian Ct., Peekskill, N.Y. 10566

[ * ] Notice: The portion of the term of this patent subsequent to Mar. 14, 2016, has been disclaimed.

[21] Appl. No.: 816,170

[22] Filed: Mar. 12, 1997

Related U.S. Application Data

[63] Continuation-in-part of Ser. No. 615,735, Mar. 14, 1996, Pat. No. 5,707,268.

[51] Int. Cl.[6] ..... A63H 33/04

[52] U.S. Cl. ..... 446/112; 446/104; 446/115; 446/122; 446/153

[58] Field of Search ..... 446/102, 104, 446/108, 111, 114, 115, 116, 119, 122, 124, 125, 177, 153

[56] References Cited

U.S. PATENT DOCUMENTS

| | | | |
|---|---|---|---|
| 1,883,214 | 10/1932 | Wilson et al. | 446/113 |
| 2,446,120 | 7/1948 | Wiswesser | 446/115 |
| 2,509,669 | 5/1950 | Borst | 446/122 |
| 3,066,436 | 12/1962 | Schuh | 446/115 |
| 3,271,895 | 9/1966 | Sorensen | 446/122 |
| 3,537,706 | 11/1970 | Heavener | 446/85 |
| 3,554,382 | 1/1971 | Grinbergs . | |
| 3,564,758 | 2/1971 | Willis | 446/114 |
| 4,065,220 | 12/1977 | Ruga | 446/114 |
| 4,666,163 | 5/1987 | Hirschfeld | 446/108 |
| 5,273,477 | 12/1993 | Adams, Jr. | 446/108 |
| 5,472,365 | 12/1995 | Engel | 446/104 |
| 5,536,009 | 7/1996 | Edwards | 446/153 |
| 5,607,339 | 3/1997 | Kramer | 446/153 |

FOREIGN PATENT DOCUMENTS

| | | | |
|---|---|---|---|
| 486018 | 5/1938 | United Kingdom | 446/124 |

*Primary Examiner*—Robert A. Hafer
*Assistant Examiner*—Jeffrey D. Carlson
*Attorney, Agent, or Firm*—Michael Ebert

[57] ABSTRACT

A transformable geometric construction set composed of triangular modules having different geometrical forms and sizes, the modules being interlinkable to create a planar mosaic that is transformable by a player into three-dimensional abstract or figurative structures having ornamental and/or utilitarian value. Each module is constituted by a triangular plate having slotted edges that define three side tines, each extending from a respective vertex. Interhinging of adjacent modules is effected by a coupling sleeve fitting over abutting tines of the modules whereby the modules can then be angled with respect to each other. Two adjacent modules may also be interconnected by intermeshing the abutting side tines of these modules.

15 Claims, 7 Drawing Sheets

FIG. 5
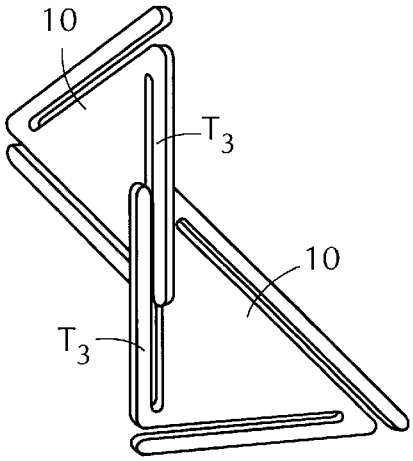
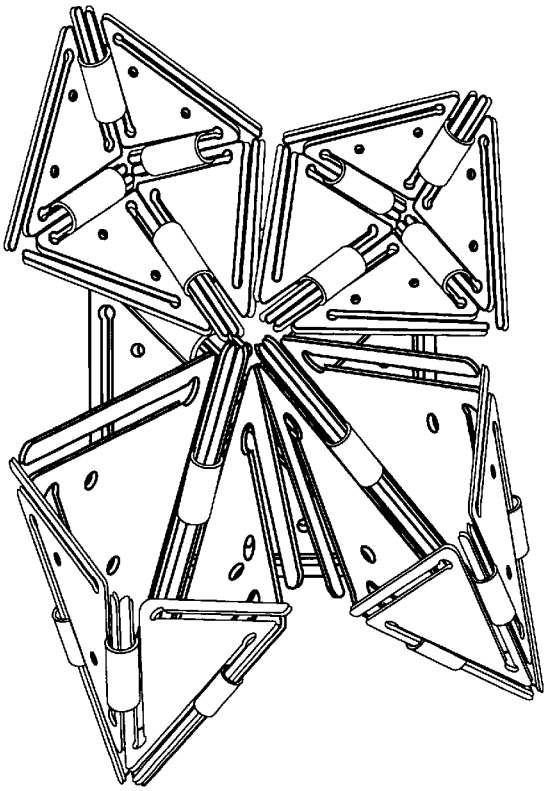
FIG. 9
FIG. 10
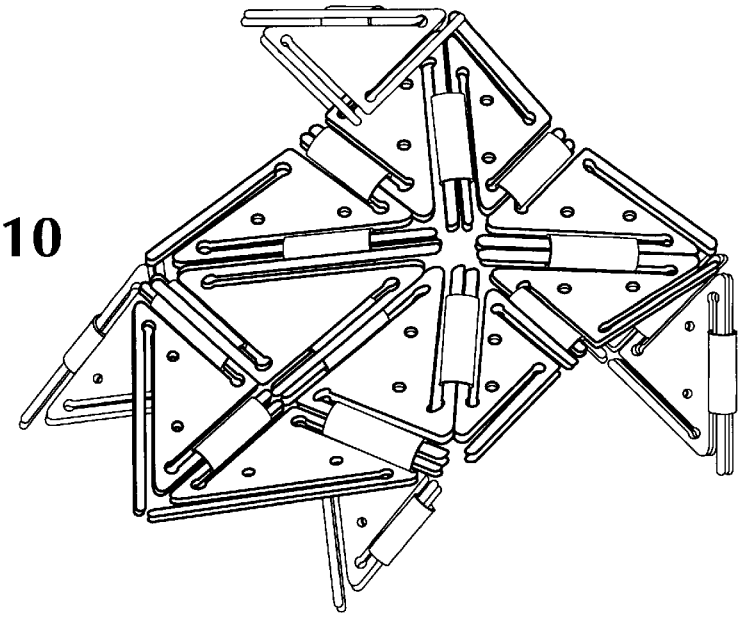

FIG. 8
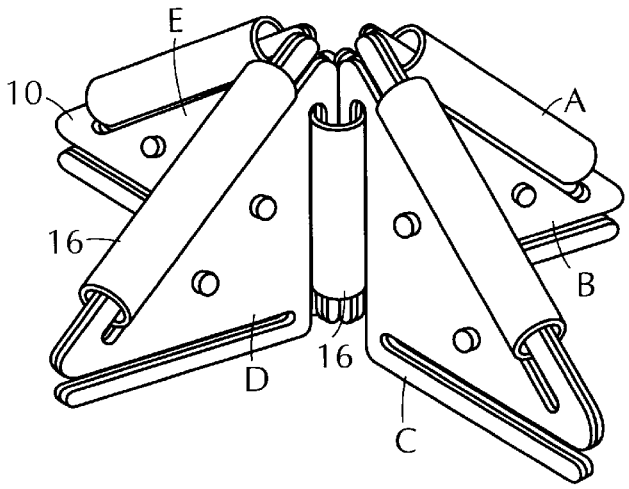
FIG. 6
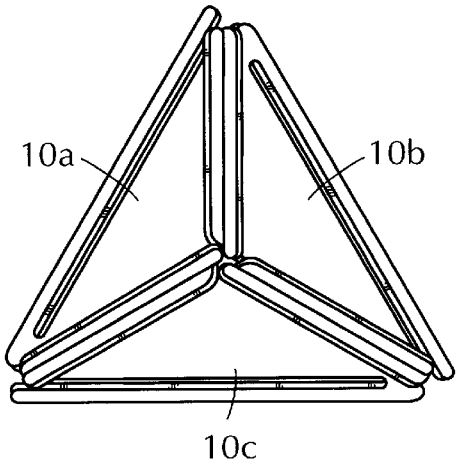
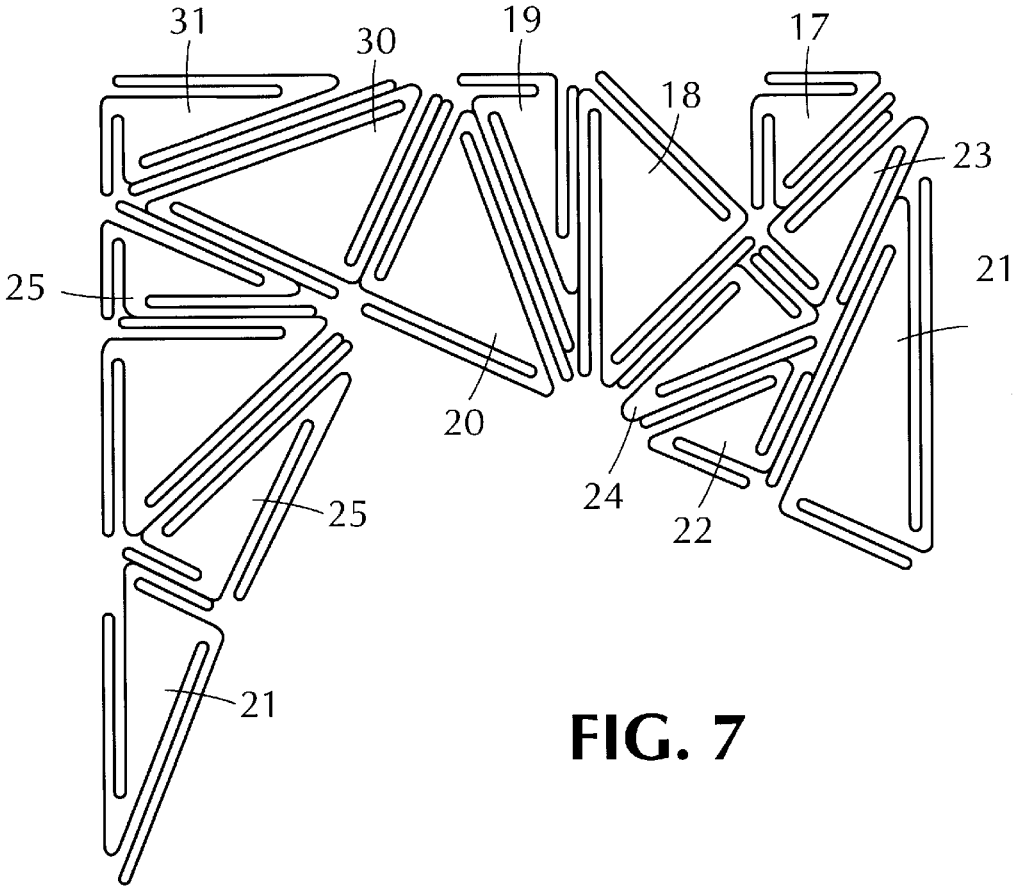
FIG. 7

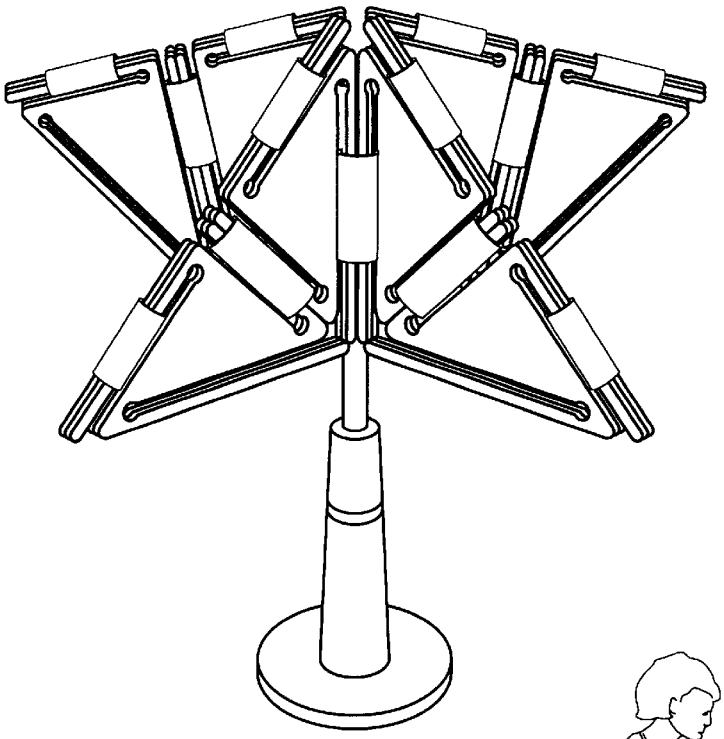
FIG. 14
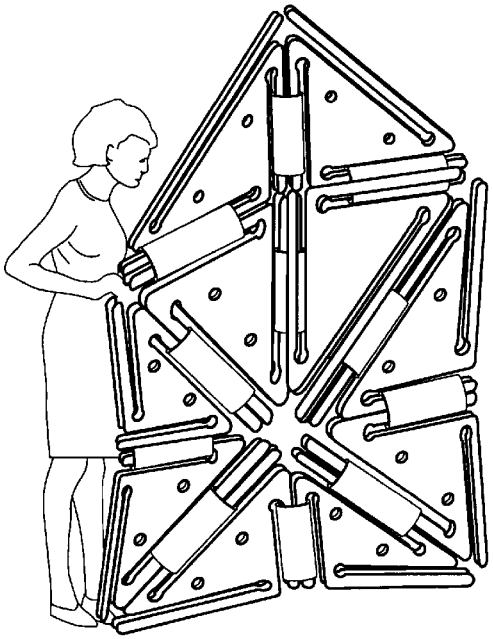
FIG. 15
FIG. 18
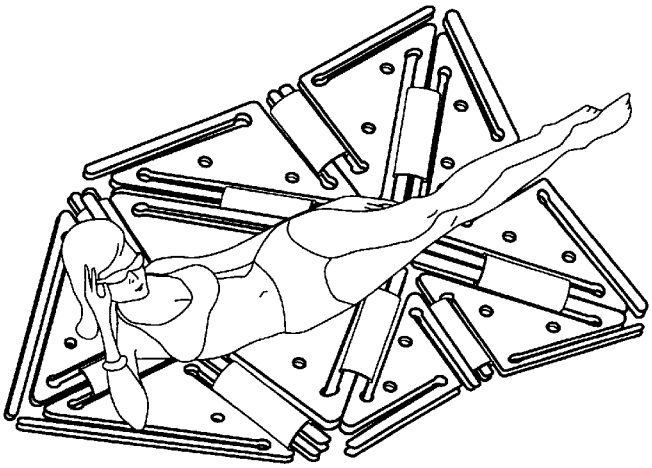

TRANSFORMABLE GEOMETRIC CONSTRUCTION SET AND THREE-DIMENSIONAL STRUCTURES CONFIGURABLE THEREFROM

RELATED CASES

This application is a continuation-in-part of the application Ser. No. 08/615,735, filed Mar. 14, 1996, (now U.S. Pat. No. 5,707,268, granted Jan. 13, 1998) entitled "GEOMETRIC CONSTRUCTION TOY SET" the entire disclosure of which is incorporated herein by reference.

BACKGROUND OF INVENTION

1. Field of Invention

This invention relates generally to construction sets and three-dimensional structures configured therefrom, and more particularly to a construction set in which triangular modules can be interconnected to create a planar mosaic that is transformable by a player into three-dimensional abstract or figurative structures whose configuration depends on the imagination of the player.

2. Status of Prior Art

The most elementary form of a construction toy set consists of blocks all having the same cubical dimensions which a pre-school child can stack and assemble to create structures whose form depends on how the blocks are put together by the child.

There are numerous prior art construction sets such as these sold under the trademarks TINKERTOY and LEGO in which the pieces which make up the set can be joined to enable the player to create three-dimensional forms which do not fall apart, yet can be disassembled. These construction toys serve not only to entertain and amuse the player, but because they effectively teach the child basic principles of geometry and construction, the toy performs a useful educational function.

The 1993 Swan U.S. Pat. No. 5,183,432 discloses a geometric toy construction system formed by flat triangular pieces which are interengageable in edge-to-edge relation to form two and three dimensional structures. The edgewise connectors on the pieces make it possible to snap-fit them together and to rotate the pieces about their axis of interconnection. The connectors are formed by connector sets projecting from the edges of the triangular pieces.

The 1987 U.S. Pat. No. to Gould 4,685,892 shows a toy construction set having triangular pieces each of whose edges has a tab connected thereto by a living hinge, the tabs of adjacent pieces being interconnected. In the 1976 U.S. Pat. No. 3,987,580 to Ausnit, a construction toy is disclosed formed by flexible geometric pieces each of which has a plurality of edges, each edge being provided with a resilient interhooking rib and groove fastener that can be pressed into engagement with the fastener on the edge of another piece.

In the toy construction set shown in the 1962 U.S. Pat. No. 3,066,436 to Schuh, the set is composed of flat rectangular units which are slotted so that the units can be interconnected in various ways. The 1978 U.S. Pat. No. to Daugherty 4,073,105 discloses a fabrication device in which triangular modules are interconnected, the edges of each module being curled to form a hook which can be coupled to a similar hook formed in the edge of an adjacent module.

In the 1971 Grinbergs U.S. Pat. No. 3,554,382, there is shown a construction system formed by modular square panels having edge slots so that the panel may be interconnected by a coupling collar engaging the slots of abutting panels.

SUMMARY AND OBJECTS OF INVENTION

In view of the foregoing, the main object of this invention is to provide a transformable geometric construction set composed of flat triangular modules which are interconnectable to create a planar mosaic that can be manipulated by a player to erect three-dimensional abstract or figurative structures whose configuration depends on the imagination of the player.

More particularly, an object of this invention is to provide a set of the above type in which each triangular module regardless of its geometric form and size has slotted edges which define three side tines making it possible to interconnect or interhinge adjacent modules.

Among the significant advantages of a set in accordance with the invention over prior art geometric construction toys are the following:

A. The interconnectable triangular modules which make up the set are single, flat pieces molded of synthetic plastic material and therefore can be mass-produced at low cost.

B. The connectors for interhinging the modules in the set are inexpensive tubular plastic sleeves.

C. The triangular modules included in the set, though varying in their geometric forms and sizes are interconnectable to form a planar mosaic which lends itself to manipulation by a player so that the modules are angled with respect to each other to create three-dimensional structures.

D. There is no real limit to the number or size of triangular modules which make up the set, and to the uses to which the set can be put. Moreover, the greater the number, the more complex the mosaic and the resultant structures which can be created by manipulating the mosaic.

Briefly stated, these objects can be attained by a transformable geometric construction set composed of triangular modules having different geometrical forms and sizes, the modules being interlinkable to create a planar mosaic that is transformable by a player into three-dimensional abstract or figurative structures having ornamental and/or utilitarian value.

Each module is constituted by a triangular plate having slotted edges that define three side tines, each extending from a respective vertex. Interhinging of adjacent modules is effected by a coupling sleeve fitting over abutting tines of the modules whereby the modules can then be angled with respect to each other. Two adjacent modules may be also interconnected by intermeshing the abutting side lines of these modules.

BRIEF DESCRIPTION OF DRAWINGS

For a better understanding of the present invention, as well as further features thereof, the following Detailed Description should be read in conjunction with the annexed drawings, wherein:

FIG. 5 shows how two modules of the present invention may be interconnected without the need for a coupling sleeve;

FIG. 6 shows a triangular pyramid created by the modules of the present invention;

FIG. 7 shows a portion of a planar mosaic formed by a plurality of triangular modules of the present invention;

FIG. 8 illustrates a three-dimensional star-shaped structure formed by interhinged modules of the present invention;

FIGS. 9, 10, 11 and 12 illustrate different three-dimensional structures formed from interhinged modules of the present invention;

FIG. 14 illustrates a lamp shade formed by the interhinged modules of the present invention, in which translucent material is used;

FIG. 15 illustrates a privacy screen structure formed by the interhinged modules of the present invention;

FIG. 18 shows a flotation device created from interhinged foam modules of the present invention.

DESCRIPTION OF INVENTION

A transformable geometric construction set in accordance with the invention is composed of triangular modules and connectors therefor for interhinging adjacent modules. It is important therefore that the geometrical forms of a Euclidean triangle be understood, for it is these forms which make it possible to interfit a set of triangular modules which differ in their geometrical form and size.

A triangle is a two-dimensional form bounded by three straight sides which meet at three points called vertices. A triangle has three angles, each defined by two sides meeting at a vertex. Regardless of the geometric form of the triangle, its three angles have a sum total of 180 degrees. An equilateral triangle has three equal sides and three 60 degree angles, while a triangle having two equal sides is referred to as an isosceles triangle. But if no two sides are equal, then the triangle is referred to as "scalene."

In a right-angle triangle, one angle is 90 degrees and the other two have a total of 90 degrees, such as 45°+45° or 22.5°+67.5°. Thus while all triangles are three sided and have three-angles, they may differ in their geometric form and sizes.

In a transformable geometric construction set in accordance with the invention, the set is composed of triangular modules formed by flat plates having three sides whose edges are slotted to define three side tines. These tines make it possible to interconnect or to interhinge adjacent modules at their abutting sides to create a two-dimensional mosaic formed of a plurality of triangular modules. This mosaic maybe manipulated by a player so as to angle abutting modules with respect to each other and thereby create three-dimensional abstract or figurative structures whose configuration depends on the imagination of the player.

Figure 1:
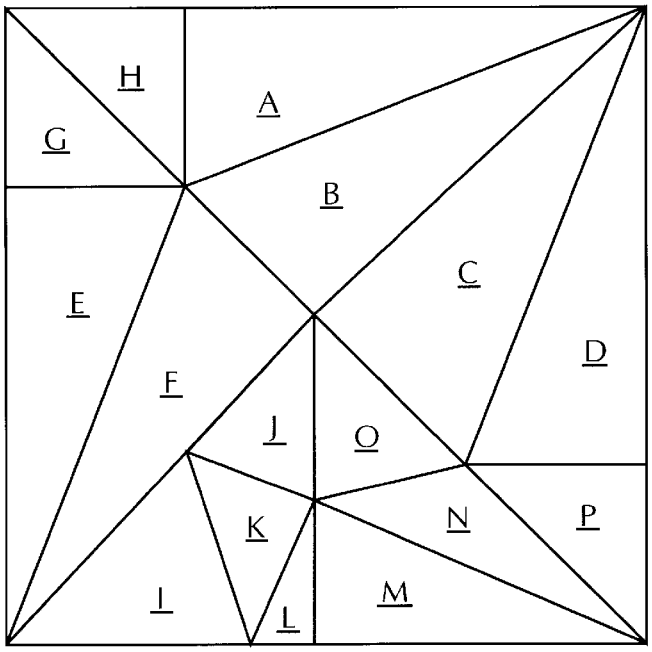
FIG. 1 schematically illustrates a blank composed of interfitting triangular modules included in a transformable geometric construction set in accordance with the invention.

Illustrated in FIG. 1 is a planar mosaic formed by interfitting triangular modules A to P which together create a rectangular two-dimensional blank. It will be seen that in this blank, triangular modules A to F have the same size and geometric form, while other modules G to P have different geometric forms and sizes.

Figure 2:
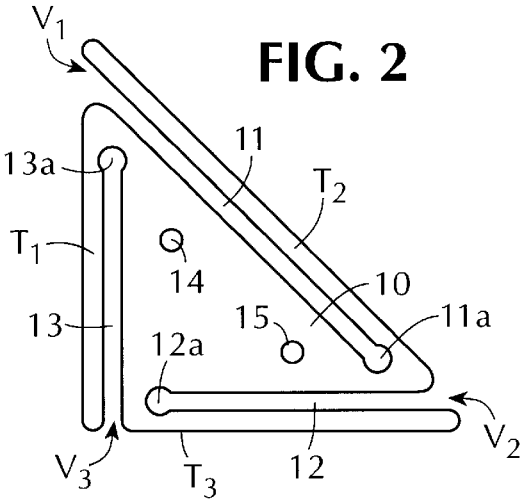
FIG. 2 is a plan view of one of the triangular modules of the present invention.
Figure 3:
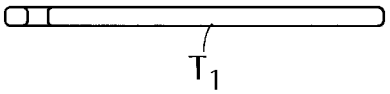
FIG. 3 is a side view of the module shown in FIG. 2.
Figure 11:
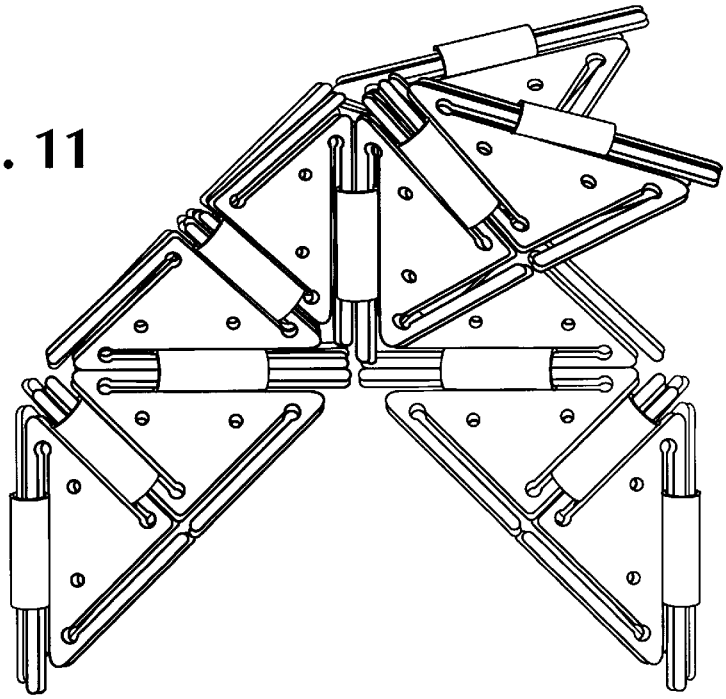
Figure 12:
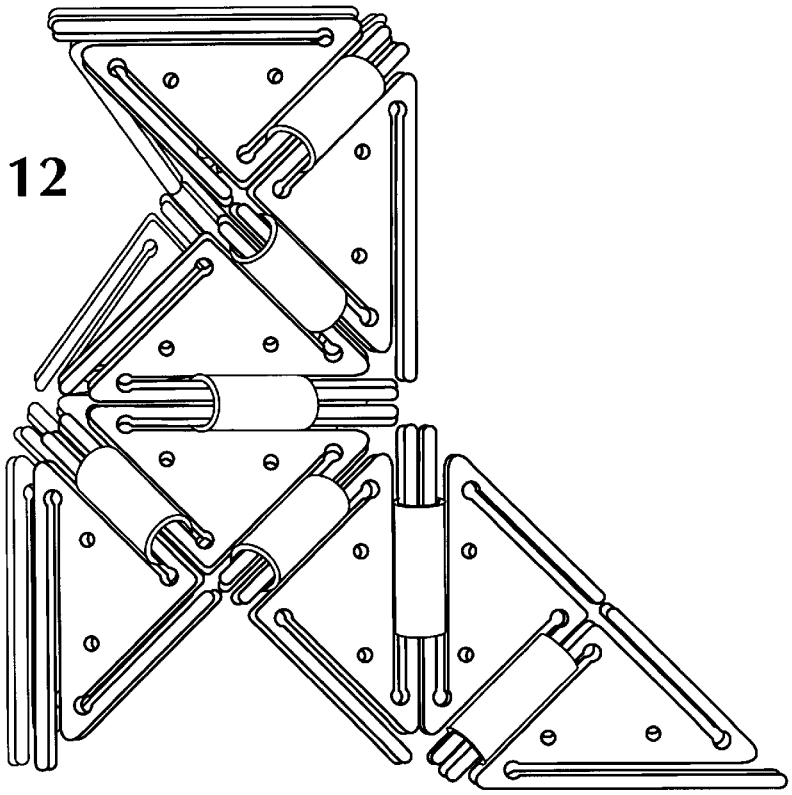

An example of a three-sided, right-angle triangular module in accordance with the invention is modules 10 shown in FIGS. 2 and 3. This modules has a 90 degree angle and two 45 degree angles so that it is an isosceles triangle. It is to be understood that the modules which compose the set may have other geometric forms and sizes as long as they are capable of being interfitted with other modules to create a planar mosaic.

Module 10 is preferably molded and die-cut or otherwise fabricated of polyethylene, polypropylene or other high-strength synthetic plastic material to form a thin flexible triangular plate. The three side edges of this plate have elongated slots therein (11, 12 and 13) which are parallel to these edges to define side tines $T_1$, $T_2$ and $T_3$. Tine $T_1$ extends from vertex $V_1$, tine $T_2$ extends form vertex $V_2$ and tine $T_3$ from vertex $V_3$. The end of each slot adjacent its vertex is enlarged by an aperture (11*a*, 12*a* and 13*a*) to provide a hinge point for each tine adjacent its vertex to facilitate flexing of the tine.

The triangular plate of module 10 is provided with a pair of spaced holes 14 and 15 adapted to receive pegs which serve to join together two interhinged modules when these modules are in superposed relation to form a double module.

Figure 4:
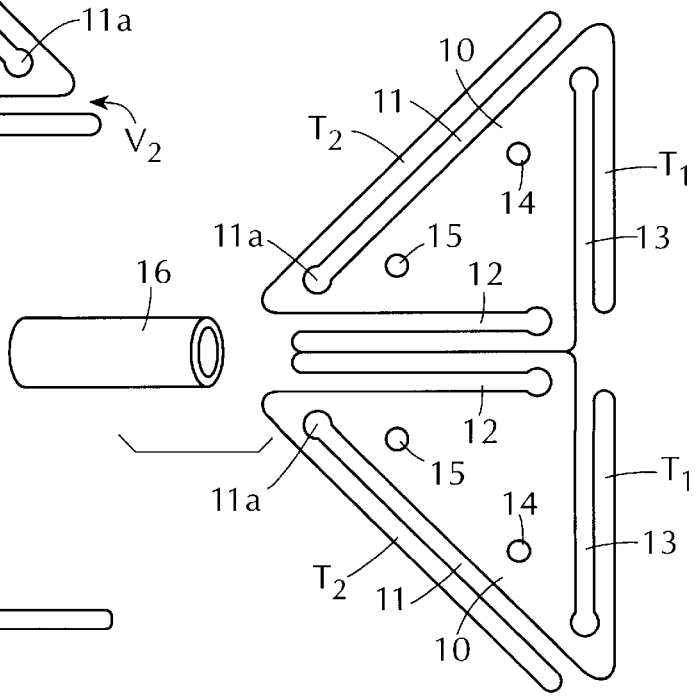
FIG. 4 shows two adjacent modules and a coupling sleeve for interhinging these modules of the present invention.

The three side tines $T_1$, $T_2$ and $T_3$ of each triangular module make it possible to interhinge adjacent modules having side tines in abutting relation. Thus as shown in FIG. 4, a pair of like right-angle triangular modules 10 which are identical to module 10 in FIG. 2 are placed in opposition with their side tines $T_3$ in abutting relation.

To interhinge this pair of modules, use is made for this purpose of a coupling sleeve 16. This sleeve is formed form a length of extruded synthetic plastic tubing of soft polyethylene or similar material which is collapsed when the tubing is squeezed. The length of coupling sleeve 16 is somewhat shorter than the length of the abutting tines to which it is to be applied. And the internal diameter of sleeve 16 matches the combined widths of the abutting tines.

When therefore sleeve 16 is pushed over the abutting tine $T_3$ of the adjacent modules to occupy parallel slots 12 thereof, the modules are then interhinged by the sleeve. The interhinged modules which are initially planar, may then be manipulated by a player to assume any desired angle. Because abutting tines $T_3$ are frictionally received in sleeve 16 and are snugly held therein, the resultant hinge is somewhat stiff and acts therefore to maintain the adjusted angle of the adjacent modules.

While FIGS. 2 and 3 illustrate a three-sided triangular module 10 in accordance with the invention, having an isosceles form, it is to be understood that module 10 is by way of example only, and that the modules which compose the set may differ in their triangular geometries and size, as shown in FIG. 1.

Instead of interhinging adjacent modules 10, they may be interconnected as shown in FIG. 5 by intermeshing their abutting tines, the tine of each module entering the slot of the adjacent module. By so interconnecting three like modules 10*a*, 10*b* and 10*c*, as shown in FIG. 6, one can create a triangular pyramid.

FIG. 7 illustrates a portion of a planar mosaic formed by interfitting triangular modules 17 to 31 of different geometric form and size which maybe interhinged by coupling sleeves 16 which fit over the abutting tines of adjacent modules or they maybe interconnected by intermeshing these tines.

FIG. 8 shows a geometric figure created by interhinging four pairs A, B, C and D of like modules 10. Each pair is formed by superposed twin modules interhinged by coupling sleeves 16. The peg holes included in the modules are used to receive removable pegs to join and rigidify the superposed triangular modules shown in FIG. 8, and their use is therefore optional.

A planar mosaic created by interhinged triangular modules is transformable into three-dimensional abstract or figurative forms that depend on the geometric forms and sizes of the modules which make up the mosaic and on the imagination of the player who manipulates the mosaic. FIGS. 9 to 12 illustrate four of such abstract three-dimensional forms.

In FIG. 14, the transformable geometric construction set of the present invention has been used to construct a lamp shade structure supported from a lamp post in a conventional manner. In a preferred embodiment, the lamp shade is made from a translucent material to allow a desired amount of light transmission therethrough and create attractive lighting effects. The lamp shade can be easily reconfigured in any manner desired by its user.

In FIG. 15, the transformable geometric construction set of the present invention has been used to construct a privacy screen, wind screen, or spatial barrier for use in either indoor or outdoor environments. In such an illustrative embodiment, the size of each module is designed larger than in the lamp shade embodiment of FIG. 14, for example, so that fewer modules are required to create a three-dimensional privacy screen having dimensions suitable for typical living environments. In such illustrative embodiments, the modules can be translucent, semitransparent or opaque materials, and can be anchored to the ground or floor using weighs or anchoring devices well-known in the art. Alternatively, the modules disposed closest to the floor or ground surface can be realized as hollow structures fillable with a liquid, such as water, or granular material, such as sand, to secure the entire three-dimensional structure in a desired location.

In FIG. 18, the transformable geometric construction set of the present invention has been used to construct a floatation device for lounging or reclining in a swimming pool, a pond, or on any deck surface where comfort and support are desired while resting or playing. In this illustrative embodiment, the size of the modules are again larger than in the lamp shade embodiment of FIG. 14, and are made of materials such as plastic tubing and open-cell foam so that the entire structure has the necessary buoyancy characteristics to float upon a water surface while supporting the weight of its user. If desired, the surfaces of the modules can be made light reflective to enhance light reflection and focusing and thus skin tanning of its user. Rigid or deformable grip-type handles can be provided to particular modules to facilitate reconfiguration, handling and use of the device, as desired or required by any particular application.

In its present or modified form, the illustrative embodiment of FIG. 18 can be readily used as a transport vehicle (e.g. snow board, snow-sled or skiing platform). Preferably, such an embodiment of the present invention is provided with rigid or deformable grip-type handles on one or more of the modules for support and control. A tow rope can be connected to one end of the device for carrying out pulling operations and/or steering control. The handles can be held onto while down-hill sledding and used to steer the snow transport vehicle. One notable advantage of the snow transport vehicle is that the hinged modules forming the bottom surface thereof will naturally conform to the snow surface during sledding or sleighing, providing a safer, more stable ride for its users.

Figure 16:
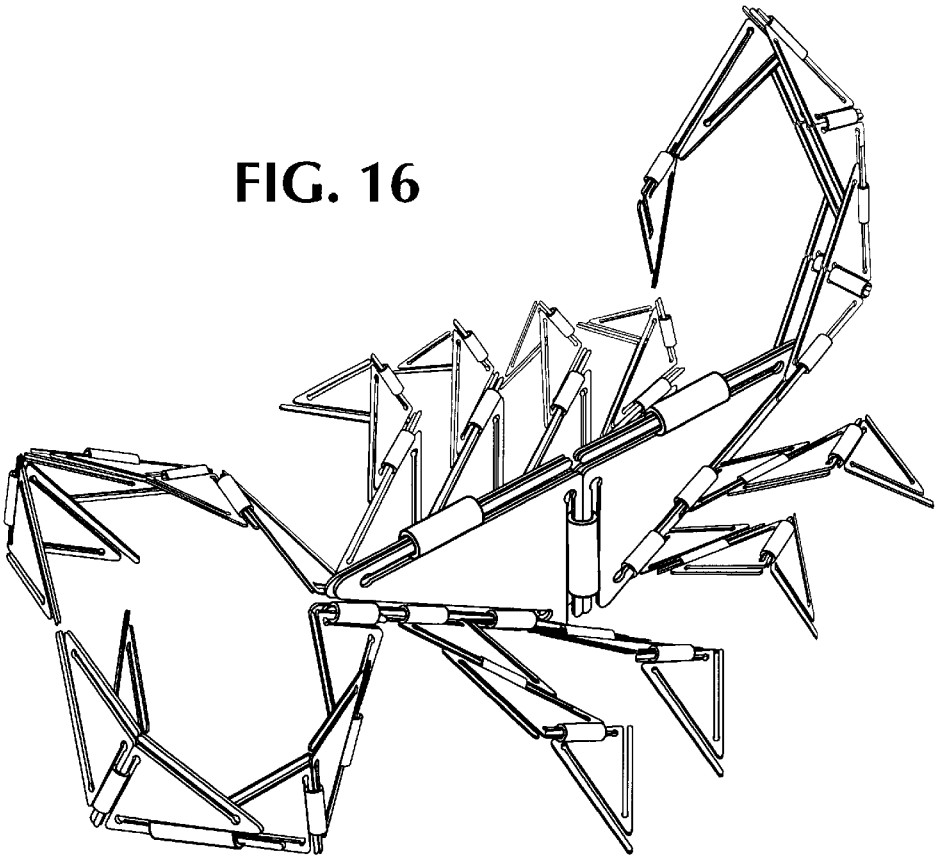
FIGS. 16 and 17 illustrate three-dimensional figurine-type structures formed from interhinged modules of the present invention.
Figure 17:
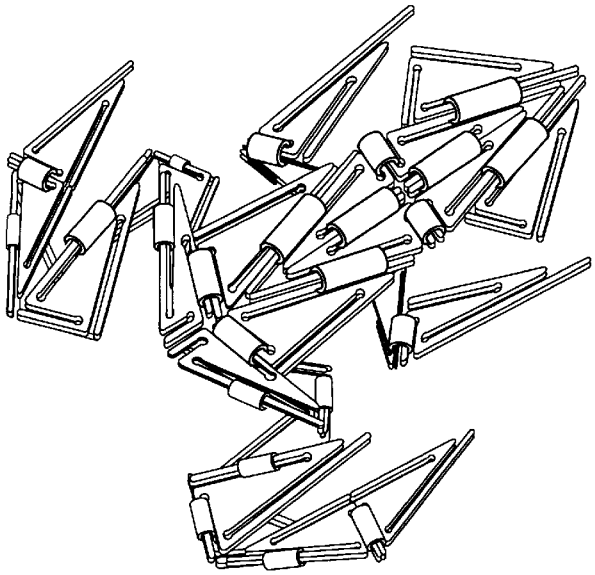

In FIG. 16, the transformable geometric construction set of the present invention has been used to create a toy scorpion-like figure, and in FIG. 17, is transformed into a frog-like figure. In these illustrative embodiments of the present invention, the size of the modules can be smaller than, equal to, or greater than the modules of the lamp shade shown in FIG. 14 embodiment.

Figure 19:
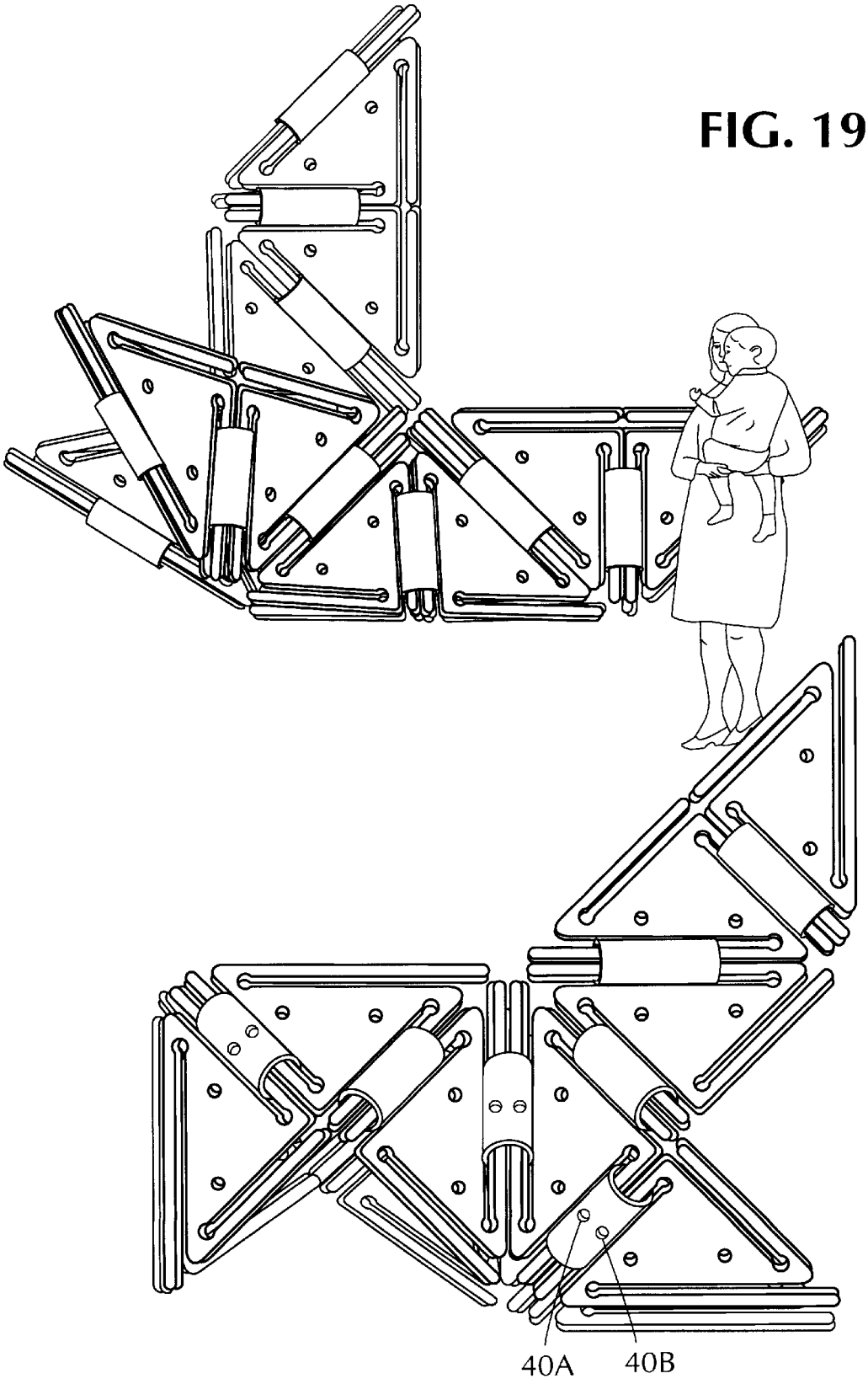
FIG. 19 shows play-ground type structures made from larger interhinged modules of the present invention.

In FIG. 19, the transformable geometric construction set of the present invention has been used to create playground-type structures, having tunnels and/or cavities, about which, under which or through which children and adults alike can crawl. In such an illustrative embodiment, it might be desirable to lock adjacent or contiguous modules in spatial relationship with each other once a desired configuration has been attained. Such adjacent module locking mechanism can be realized out by screwing plastic or metal screws 40A and 40B through holes formed through coupling collar 16 and the tines contained therein, as .indicated in selected modules of the structures shown in FIG. 19.

Figure 13:
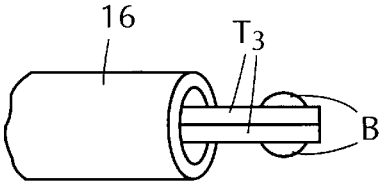
FIG. 13 shows a modified form of side tine included in a triangular module.

In practice, to prevent a coupling collar 16 interhinging abutting tines $T_3$ as shown in FIG. 13 from slipping off the tines, the tines may each be provided adjacent their free end with a detent bump B.

Also in practice, those modules in the set which have the same geometric shape and size may have a distinct color, imparted thereto to distinguish the modules form those having a different geometric shape and size and a different color. By so color coding the modules which compose the set, it makes it easier to interfit modules of different geometric shapes and sizes into a planar mosaic. And it adds to the attractiveness of the structures produced by the modules.

Color coding the modules or applying unique characters, numbers or symbols thereto can also facilitate the formulation of specific sets of instructions which, when followed in a specified sequence, results in particular 3-D structures. Such instructions can be recorded in a booklet, or electronically represented on a CD-ROM disk for playback on a multimedia computer system. Preferably, a construction booklet or CD-ROM disk (with figures and voice tracks) would accompany each toy construction set of the present invention, providing additional value to the consumer.

While there has been shown and described preferred embodiments of a transformable geometric construction set in accordance with the invention, it will be appreciated that many changes and modifications may be made therein without, however, departing from the essential spirit thereof.

I claim:

1. A transformable geometric construction set composed of triangular modules which are interlinkable to form a planar mosaic which can be manipulated by an operator to transform the mosaic into three-dimensional structures, each module comprising A. a triangular plate having three sides which meet at vertices, each vertex being formed at a point where two of the sides meet;

B. an elongated slot adjacent an outer edge of each side of the plate and parallel thereto, said slot having a length substantially similar to that of the side to define a tine which extends from a respective vertex to a free end whereby when modules in the set are placed adjacent each other, corresponding tines of the modules are then in abutting relation and can therefore be interlinked, and C. an elongated coupling sleeve which fits over the abutting tines and is received within the elongated slots associated therewith to interhinge the adjacent modules, said modules being formed of translucent synthetic plastic-material whereby the resultant three-dimensional structures are light permeable.

2. A construction toy as set forth in claim 1, in which abutting corresponding tines are intermeshed so that each tine is received in the slot associated with another tine.

3. A construction set as set forth in claim 1, in which the sleeve has an internal diameter which substantially matches the combined widths of the abutting corresponding tines.

4. A construction toy as set forth in claim 3, in which the sleeve is formed of a tube of synthetic plastic material which is flexible.

5. A construction toy as set forth in claim 4, in which the sleeve is formed of polyethylene.

6. A construction toy as set forth in claim 1, in which each tine is provided adjacent its free end with a detent bump which when the coupling sleeve is fitted over adjacent tines, then prevents the sleeve from falling off the tines.

7. A construction set as set forth in claim 1, in which at least one module in the set has an equilateral triangular form.

8. A construction set as set forth in claim 1, in which at least one module in the set has an isosceles triangular form.

9. A construction set as set forth in claim 1, in which said elongated slot terminates in a hole to create a hinge point at said vertex.

10. A transformable geometric construction set as set forth in claim 1, in which the triangular modules which compose the set have different geometric shapes and sizes.

11. A construction set as set forth in claim 10, in which modules in the set which have the same geometric shape and size have a distinct color imparted thereto to distinguish these like modules form those like modules in the set having a different geometric shape and size and different color.

12. The play structure of claim 1, wherein one or more adjacent triangular modules are provided with position locking means for locking said adjacent triangular modules in spatial relationship with each other once a desired configuration has been attained.

13. The play structure of claim 12, wherein said position locking means comprises one or more screws extending through holes formed through said tines associated with said adjacent triangular modules.

14. A construction set as set forth in claim 1, in which the three-dimensional translucent structure is shaped to form a lamp shade.

15. A construction set as set forth in claim 1, in which the three dimensional translucent structure is shaped to form a privacy screen.

* * * * *